US011179865B2

(12) United States Patent
Inayoshi et al.

(10) Patent No.: US 11,179,865 B2
(45) Date of Patent: Nov. 23, 2021

(54) LEVER DEVICE

(71) Applicant: MAKITA CORPORATION, Anjo (JP)

(72) Inventors: Hirotomo Inayoshi, Anjo (JP); Hiroto Korekawa, Anjo (JP); Yuta Yamashita, Anjo (JP); Masaki Murakami, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/097,097

(22) Filed: Nov. 13, 2020

(65) Prior Publication Data

US 2021/0162621 A1 Jun. 3, 2021

(30) Foreign Application Priority Data

Nov. 29, 2019 (JP) ..... JP2019-216879

(51) Int. Cl.
*B27B 9/02* (2006.01)
*B27B 5/29* (2006.01)

(52) U.S. Cl.
CPC . *B27B 9/02* (2013.01); *B27B 5/29* (2013.01)

(58) Field of Classification Search
CPC .... B27B 9/02; B27B 5/29; B27B 5/70; B27B 9/00; B23D 45/14; B23D 59/001; B27G 19/04
USPC ..... 30/337, 376, 388, 390, 374, 375, 391, 30/293, 320, 296.1, 50.5, 151; 83/473, 83/471.3, 529
See application file for complete search history.

(56) References Cited

U.S. PATENT DOCUMENTS 3,757,787 A * 9/1973 Gottlieb ..... A61B 17/326 606/118
4,870,758 A * 10/1989 Fushiya ..... B27B 9/02 30/388
6,301,789 B1 * 10/2001 Zeiler ..... B23D 59/001 30/374
6,601,305 B1 * 8/2003 Fukuoka ..... B27B 9/02 30/376
2005/0155232 A1 7/2005 Bocka et al.
2006/0117578 A1 * 6/2006 Nashimoto ..... B27B 9/02 30/377

(Continued)

FOREIGN PATENT DOCUMENTS

JP 2001-047401 A 2/2001
JP 4902360 B2 3/2012

*Primary Examiner* — Ghassem Alie
(74) *Attorney, Agent, or Firm* — Oliff PLC

(57) ABSTRACT

A lever device is configured such that, when first and second plates are relatively moved in a direction in which a second end part of the first plate and a fourth end part of the second plate are close to each other from a state in which the second end part and the fourth end part are separated from each other in an axial direction of a bolt, the first plate is rotated around a fulcrum positioned between a first engagement part and the second end part in the crossing direction so that the first plate is moved from an engaged position where the first engagement part and a non-circular part of the bolt or a nut are engaged to a non-engaged position where they are not engaged, and thereby removing a restriction of the relative rotation of the first plate to the non-circular part.

11 Claims, 6 Drawing Sheets

(56) References Cited

U.S. PATENT DOCUMENTS

| | | | | |
|---|---|---|---|---|
| 2008/0172891 | A1* | 7/2008 | Nie | B27B 9/02 30/376 |
| 2012/0198708 | A1* | 8/2012 | Naito | B27B 9/00 30/371 |
| 2014/0218539 | A1* | 8/2014 | Matsui | H04N 17/045 348/179 |
| 2014/0331505 | A1* | 11/2014 | Kume | B23D 59/00 30/390 |
| 2017/0173814 | A1* | 6/2017 | Baxivanelis | B27B 9/02 |
| 2018/0071955 | A1* | 3/2018 | Rybka | B27B 9/02 |

* cited by examiner

LEVER DEVICE

TECHNICAL FIELD

The present disclosure relates to a lever device.

BACKGROUND ART

A portable cutting machine called a portable circular saw (hereinafter, referred to merely as a circular saw) includes a base formed in a generally rectangular shape and having a bottom surface to be brought into contact with a workpiece to be cut, and a body part. The body part includes an electric motor, and a saw blade, which is called a tipped saw blade, formed in a generally circular shape, and rotationally driven by the electric motor. The body part is arranged opposite to the bottom surface with respect to the base such that a part of the saw blade passes through a through hole formed in the base so as to protrude beyond the bottom surface of the base. When the cutting machine is used, a user brings the bottom surface of the base into contact with a workpiece to be cut while the saw blade is rotating, and then the user moves the cutting machine on the workpiece. As a result, the saw blade, which protrudes beyond the bottom surface, cuts the workpiece along a moving direction of the cutting machine.

A circular saw in which a protrusion amount of a saw blade is adjustable by swinging a body part around a support shaft has been well-known as one example of the circular saw. Such a circular saw adopts a lever device for fixing a pivotal position of the body part with respect to the base. For example, a lever device including a bolt, a nut screwed with the bolt, and a lever engaged with an outer periphery of the nut has been known as such a lever device. In such a lever device, the bolt penetrates both of a depth guide that is fixed to the base-side (namely, the base itself or other component fixed to the base) and a blade case that houses the saw blade and is fixed to the body part-side (namely, the body part itself or other component fixed to the body part). By fastening the nut using the lever, the depth guide and the blade case are fastened in an axial direction of the bolt, so that the relative positions of the depth guide and the blade case are fixed.

In most of the lever devices, a mounting angle of the lever to the nut is adjusted such that the lever is positioned to be adjacent to the base when the lever is rotationally operated to a position where the nut is completely fastened (hereinafter, also referred to a lock position) due to the restriction of a space for the rotational operation of the lever.

In such a case, when deformation of any of the components is caused by repeatedly using the lever device, the lock position of the lever might be shifted to be close to the base. With this configuration, it might be difficult to put a finger into a gap between a distal end of the lever and the base. Consequently, loosening the lever might be difficult.

Against such a problem, Japanese Unexamined Patent Application Publication No. 2001-047401 discloses a lever device in which a mounting angle of the lever to a nut is adjustable. According to this lever device, the mounting angle of the lever to the nut can be changed without using any tool.

SUMMARY

One aspect of the present disclosure provides a lever device. The lever device includes a bolt, a nut screwed with the bolt, a first plate, and a second plate. The first plate includes a first end part and a second end part. The first plate extends to be elongate from the first end part to the second end part in a crossing direction crossing an axis of the bolt. The second plate includes a third end part and a fourth end part. The second plate extends to be elongate from the third end part to the fourth end part in the crossing direction. The bolt or the nut includes a non-circular part having a non-circular shape in cross-section orthogonal to the axis. The first plate includes a first engagement part to be engaged with the non-circular part, at a position closer to the first end part than to the second end part in the crossing direction. The second plate includes a second engagement part to be engaged with the bolt or the nut, at a position closer to the third end part than to the fourth end part in the crossing direction. The first engagement part is shaped to restrict a relative rotation of the first plate to the non-circular part when the first engagement part is engaged with the non-circular part. The second engagement part is shaped and sized to allow a relative rotation of the second plate to the non-circular part when the second engagement part is engaged with the bolt or the nut. The first engagement part is configured to be engaged with the non-circular part when the first plate is located at a first rotational position with respect to the non-circular part and when the first plate is located at a second rotational position with respect to the non-circular part. The lever device is configured such that, when the first plate and the second plate are moved relatively to each other in a direction in which the second end part and the fourth end part are close to each other from a state in which the second end part and the fourth end part are separated from each other in an axial direction of the bolt, the first plate is rotated around a fulcrum positioned between the first engagement part and the second end part in the crossing direction so that the first plate is moved from an engaged position where the first engagement part and the non-circular part are engaged with each other to a non-engaged position where the first engagement part and the non-circular part are not engaged with each other, and thereby the restriction of the relative rotation of the first plate to the non-circular part is removed.

DETAILED DESCRIPTION OF EMBODIMENTS

A portable circular saw (hereinafter, referred to merely as a circular saw) 10 according to one embodiment will be described with reference to FIG. 1 and FIG. 2. In the following description, a direction in which the circular saw 10 is moved when a user holds the circular saw 10 in user's hand to cut a workpiece to be cut (hereinafter, also referred to as a cutting direction) is defined as a front-rear direction. In the front-rear direction, a side in which the circular saw 10 is moved forward is defined as a front side, and an opposite side thereof is defined as a rear side. Further, an upper side at this time in a vertical direction is defined as an upper side, and an opposite side thereof is defined as a lower side. Further, a direction orthogonal to both of the front-rear direction and the vertical direction is defined as a lateral direction. In the lateral direction, a right side when seen from the rear side to the front side is defined as a right side, and an opposite side thereof is defined as a left side.

Figure 1:
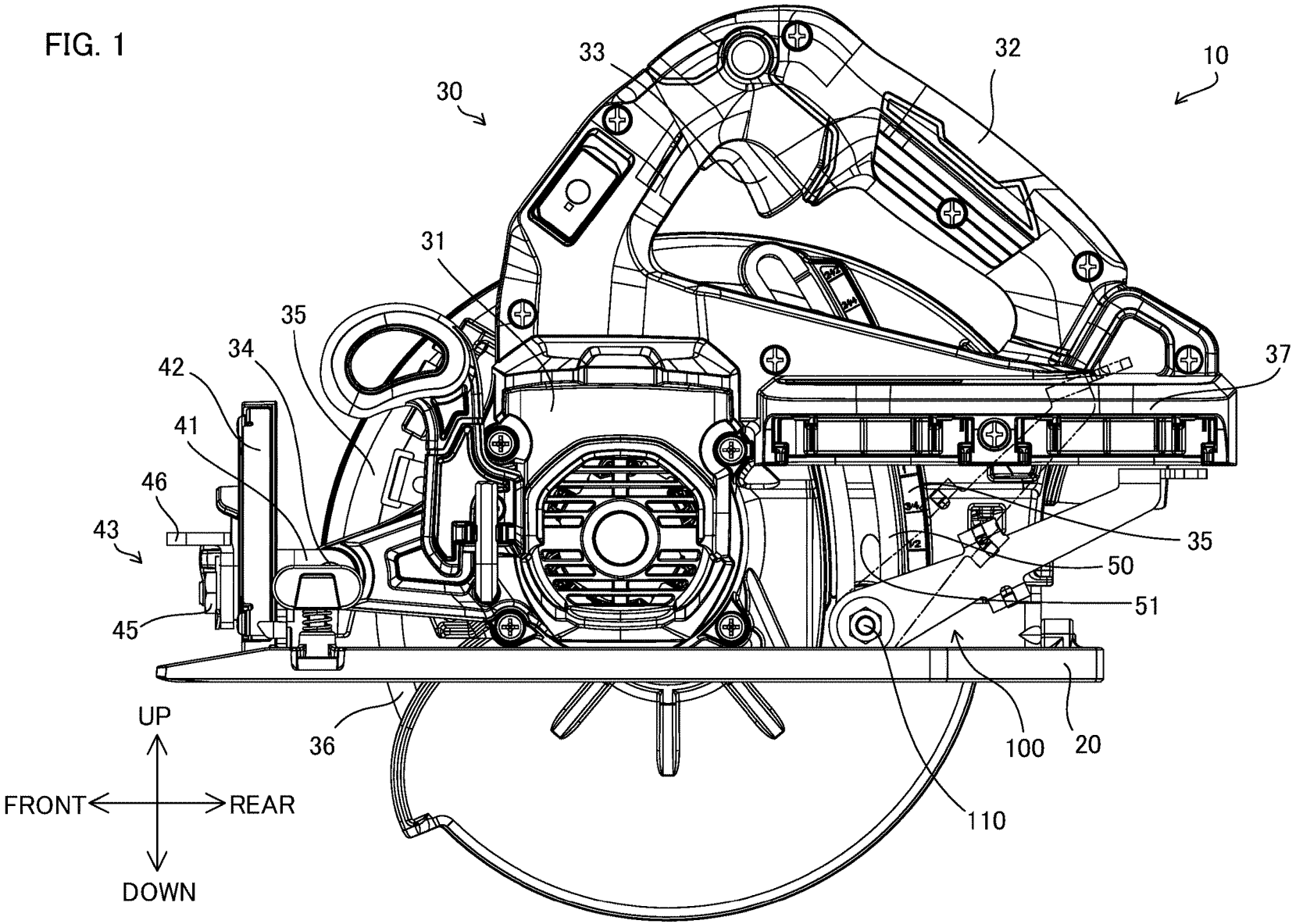
FIG. 1 is a side view of a circular saw according to one embodiment, in a state in which a battery pack is removed to enhance visibility of a lever device.
Figure 2:
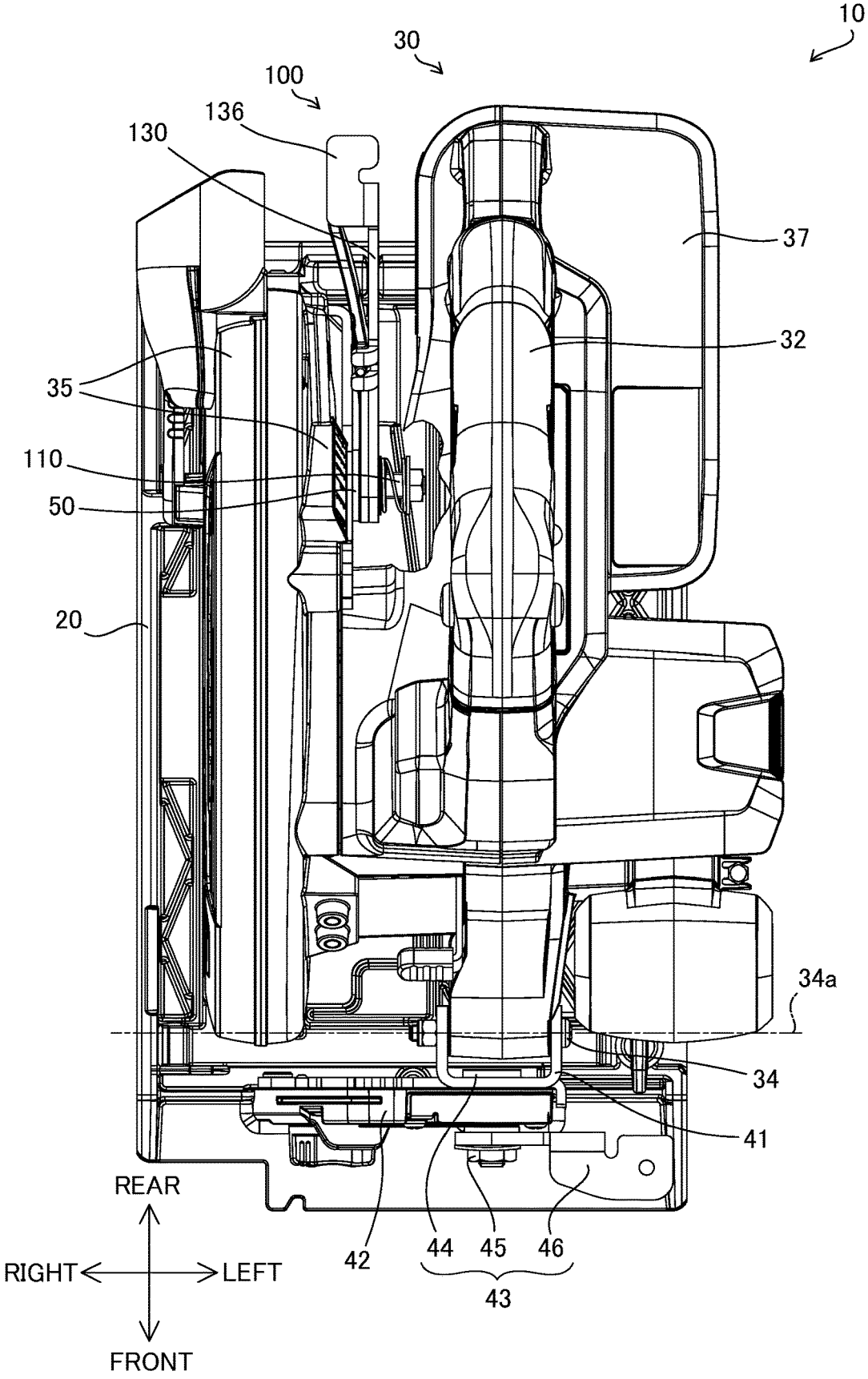
FIG. 2 is a partially broken plane view of the circular saw.

As shown in FIG. 1, the circular saw 10 includes a base 20 and a body part 30. The base 20 has an outer shape formed in a generally rectangular shape. A longitudinal direction of the base 20 is matched with the front-rear direction. The base 20 includes a bottom surface that is brought into contact with the workpiece to be cut when cutting the workpiece.

The body part 30 is basically arranged at the upper side with respect to the base 20. The body part 30 includes a motor 31, a handle 32, a saw blade 36 formed in a generally circular shape and rotationally driven by the motor 31, a fixed cover 35 that covers the saw blade 36 at the upper side with respect to the base 20, and a battery pack mounting part 37 to which a battery pack (not shown in FIG. 1) for providing electric power to the motor 31 is mounted. A part of the saw blade 36 passes through a through hole formed in the base 20 to protrude downward beyond the bottom surface of the base 20. When a user uses the circular saw 10, a user pushes a trigger 33 disposed adjacent to the handle 32, and thereby the saw blade 36 is rotated by the driving power of the motor 31. In this state, the user brings the bottom surface of the base 20 into contact with a workpiece to be cut and then moves the circular saw 10 frontward. As a result, the saw blade 36 protruding beyond the base 20 cuts the workpiece to be cut along the moving direction of the circular saw 10 (namely, the cutting direction).

The saw blade 36 is configured such that a protrusion amount downward from the base 20 is changeable. Specifically, the body part 30 is supported at the front side by a support shaft 34 extending in the lateral direction to be parallel to a rotational axis of the saw blade 36 so as to be swung around the support shaft 34 (in other words, around a pivotal axis 34*a* shown in FIG. 2). The support shaft 34 is supported by a bracket 41. When a pivotal position of the body part 30 around the support shaft 34 is changed, the protrusion amount of the saw blade 36 from the base 20 is changed.

Further, the body part 30 is supported at the rear side by a depth guide 50 when the fixed cover 35 and the depth guide 50 are fastened in the lateral direction using the lever device 100. The depth guide 50 is arranged between the fixed cover 35 and the handle 32 in the lateral direction. In the present embodiment, the lever device 100 is arranged in a narrow space between the fixed cover 35 and the battery pack (not shown in FIG. 1) to be mounted to the battery pack mounting part 37 located below the handle 32. The depth guide 50 has a guide hole 51 that penetrates the depth guide 50 in a direction orthogonal to a side surface of the saw blade 36 (namely, the lateral direction). Although the details thereof are described below, the lever device 100 includes a bolt 110, a nut 120 (see FIG. 4), and a first plate 130. The bolt 110 penetrates a through hole 35*a* (see FIG. 5) of the fixed cover 35 and the guide hole 51 of the depth guide 50 while a rotation of the bolt 110 is prevented. The guide hole 51 is formed in an arc shape around the support shaft 34, and thereby when the pivotal position of the body part 30 around the support shaft 34 is changed, the bolt 110 can move within the guide hole 51 along the arc shape of the guide hole 51.

The nut 120 is screwed with the bolt 110. The first plate 130 is engaged with an outer periphery of the nut 120. An operational part 136 operated by a user for operating the lever device 100 is disposed at a distal end of the first plate 130. When a user pinches the operational part 136 with user's fingers and rotates the first plate 130 around the bolt 110, the nut 120 engaged with the first plate 130 is rotated together with the first plate 130, so that the nut 120 is fastened. As a result, the fixed cover 35 and the depth guide 50, which are arranged between a head part 112 (see FIG. 4) of the bolt 110 and the nut 120, are fastened in the lateral direction. In this way, the fixed cover 35 (in other words, the body part 30) is fixed with respect to the depth guide 50 in accordance with the pivotal position and is supported by the depth guide 50.

The saw blade 36 is configured to be tiltingly moved with respect to the base 20 around a tilting axis that is parallel to the front-rear direction. Specifically, an angular plate 42 is mounted onto the base 20 at the front side. A lever device 43 is mounted to the angular plate 42. The lever device 43 includes a bolt 44, a nut 45, and a lever plate 46 including an operational part to be pinched by a user with user's fingers. The lever plate 46 is mounted to an outer periphery of the nut 45 while a rotation of the lever plate is prevented. The angular plate 42 has a guide hole formed in an arc shape (not shown). The bolt 44 passes through a through hole of a bracket 41 and the guide hole of the angular plate 42. When the bolt 44 is moved within the guide hole of the angular plate 42 along the arc shape of the guide hole, the bracket 41, and thus the body part 30 supported by the bracket 41 through the support shaft 34, can be tiltingly moved with respect to the base 20. When a user fastens the lever plate 46 at a desired tilting position, the bracket 41 and the angular plate 42, which are arranged between the bolt 44 and the nut 45, are fastened in the front-rear direction. As a result, the relative positions of the bracket 41 and the angular plate 42 are fixed, so that the bracket 41 is supported by the angular plate 42.

When the circular saw 10 is shipped, in the lever device 100 described above, the mounting angle of the first plate 130 to the nut 120 is set such that the first plate 130 is located adjacent to the base 20 when the first plate 130 is rotationally operated to a position where the nut 120 is completely fastened to the bolt 110.

In the present embodiment, the mounting angle can be changed by a user. Hereinafter, a configuration for changing the mounting angle will be described with reference to FIG. 3 to FIG. 6. As shown in FIG. 4, the lever device 100 includes the bolt 110, the nut 120, the first plate 130, a second plate 140, a washer 150, a biasing member 160, and an end nut 170.

The bolt 110 has an axis 111. The bolt 110 includes the head part 112, a polygonal part 113, a circular part 114, a large diameter thread part 115, and a small diameter thread part 116. The head part 112 is formed in a disc shape. The polygonal part 113 adjoins the head part 112 at the left side of the head part 112. A cross-section of the polygonal part 113 orthogonal to the axis 111 is a polygonal shape (in the present embodiment, a quadrangle). This cross-section is within an outline of the head part 112 when viewed in a direction of the axis 111. The circular part 114 adjoins the rectangular part 113 at the left side of the polygonal part 113. A cross-section of the circular part 114 orthogonal to the axis 111 is a circular shape. This circular cross-section is within an outline of the polygonal cross-section of the polygonal part 113 when viewed in the direction of the axis 111.

The large diameter thread part 115 adjoins the circular part 114 at the left side of the circular part 114. A male thread is formed on the large diameter thread part 115. A thread diameter of the large diameter thread part 115 is the same as an outer diameter of the circular part 114. The small diameter thread part 116 adjoins the large diameter thread part 115 at the left side of the large diameter thread part 115. A thread diameter of the small diameter thread part 116 is smaller than the thread diameter of the large diameter thread part 115.

The nut 120 includes a flange part 121 and a non-circular part 122. The flange part 121 is formed in a disc shape. The non-circular part 122 is located at the left side of the flange part 121. A cross-section of the non-circular part 122 orthogonal to the axis 111 is a non-circular shape (in the present embodiment, a hexagonal shape). A female thread to be screwed with the large diameter thread part 115 of the bolt 110 is formed on an inner surface that defines a through hole 123. The through hole 123 penetrates the nut 120 in the direction of the axis 111 coaxially with the axis 111.

The first plate 130 includes a first end part 131 and a second end part 132. The first plate 130 extends to be elongate from the first end part 131 to the second end part 132 in a direction crossing the axis 111 (in the present embodiment, a direction orthogonal to the axis 111, namely the front-rear direction). The first plate 130 includes a first engagement part 133 to be engaged with the non-circular part 122, at a position closer to the first end part 131 than to the second end part 132 in the front-rear direction.

In the present embodiment, the first engagement part 133 is in a form of a through hole that penetrates the first plate 130 in the direction of the axis 111 coaxially with the axis 111. More specifically, the first engagement part 133 is formed as a polygonal hole having a dodecagonal shape. The first engagement part 133 has a size and a shape into which the non-circular part 122 of the nut 120 can be inserted. In a state in which the non-circular part 122 is inserted in the first engagement part 133, the inner surface of the first engagement part 133 is engaged with the non-circular part 122, more specifically the corners of the hexagonal shape of the non-circular part 122 are positioned in the corners of the dodecagonal shape of the first engagement part 133, so that the relative movement of the first plate 130 to the non-circular part 122 around the axis 111 is restricted.

The first engagement part 133 further includes, at the second end part 132, an operational part 136 operated by a user for rotationally operating the lever device 100 (more specifically, the first plate 130) around the axis 111. The operational part 136 has a plane orthogonal to a rotation plane of the first plate 130. With this configuration, a user can pinch the operational part 136 easily with user's fingers when the user rotates the first plate 130.

The first plate 130 further includes a third engagement part 134 at a generally center thereof in the front-rear direction. The third engagement part 134 includes two claw parts 134*a* and 134*b*, each of which extends downward from the bottom surface of the first plate 130 and is bent rightward, and two claw parts 134*c* and 134*d*, each of which extends upward from a top surface of the first plate 130 and is bent rightward. The claw parts 134*a* and 134*b* are separated in the front-rear direction, and the distance therebetween is slightly larger than an outer diameter of a column part 149 described below. The claw parts 134*c* and 134*d* are disposed similar to the claw parts 134*a* and 134*b*.

The second plate 140 is arranged between the nut 120 and the first plate 130. The second plate 140 includes a third end part 141 and a fourth end part 142. The second plate 140 extends to be elongate from the third end part 141 to the fourth end part 142 in a direction crossing the axis 111. More specifically, the second plate 140 includes a portion extending in the front-rear direction (a contact portion 144 described below) and a portion extending from the contact portion 144 in a direction oblique to the front-rear direction (a non-contact portion 145 described below). In other words, the second plate 140 has a shape in which a part including the fourth end part 142 is bent in a direction far away from the first plate 130.

The second plate 140 includes a second engagement part 143 to be engaged with the non-circular part 122, at a position closer to the third end part 141 than to the fourth end part 142 in the front-rear direction. In the present embodiment, the second engagement part 143 is in a form of a through hole that penetrates the second plate 140 in the direction of the axis 111 coaxially with the axis 111. More specifically, the second engagement part 143 is formed as a round hole having a circular shape. The second engagement part 143 has a size into which the non-circular part 122 of the nut 120 can be inserted. In a state in which the non-circular part 122 is inserted in the second engagement part 143 (in other words, in a state in which the second engagement part 143 is engaged with the non-circular part 122), the relative rotation of the second plate 140 to the non-circular part 122 around the axis 111 is allowed.

The fourth end part 142 is formed in a shape to be narrower to the distal end of the fourth end part 142 when viewed from the direction of the axis 111. In other words, the fourth end part 142 is formed in a shape in which an upper side is cut. This shape facilitates the operation in which the finger hooks the fourth end part 142 from a side closer to the second end part 132 than to the fourth end part 142 so that the fourth end part 142 approaches the second end part 132 (the details thereof are described below).

The second plate 140 further includes two fourth engagement parts 147 at a generally center thereof in the front-rear direction. The fourth engagement parts 147 are disposed to be engaged with the third engagement part 134 of the first plate 130 for fixing relative positions of the first plate 130 and the second plate 140 to each other in a rotational direction around the axis 111 and fixing relative positions of the first plate 130 and the second plate 140 to each other in the front-rear direction. The third engagement part 134 and the fourth engagement parts 147 are located at generally the same position as a boundary 146 described below, in the direction orthogonal to the axis 111.

Each of the fourth engagement parts 147 includes a base part 148 that protrudes outward from a top surface or a bottom surface of the second plate 140, and a column part 149 that protrudes further outward from the center of the base part 148. The base part 148 is formed in an elongate shape in which a width in the front-rear direction is larger than a width in the vertical direction. The column part 149 is formed in a cylindrical shape having a diameter slightly smaller than the width of the base part 148 in the vertical direction.

Figure 3:
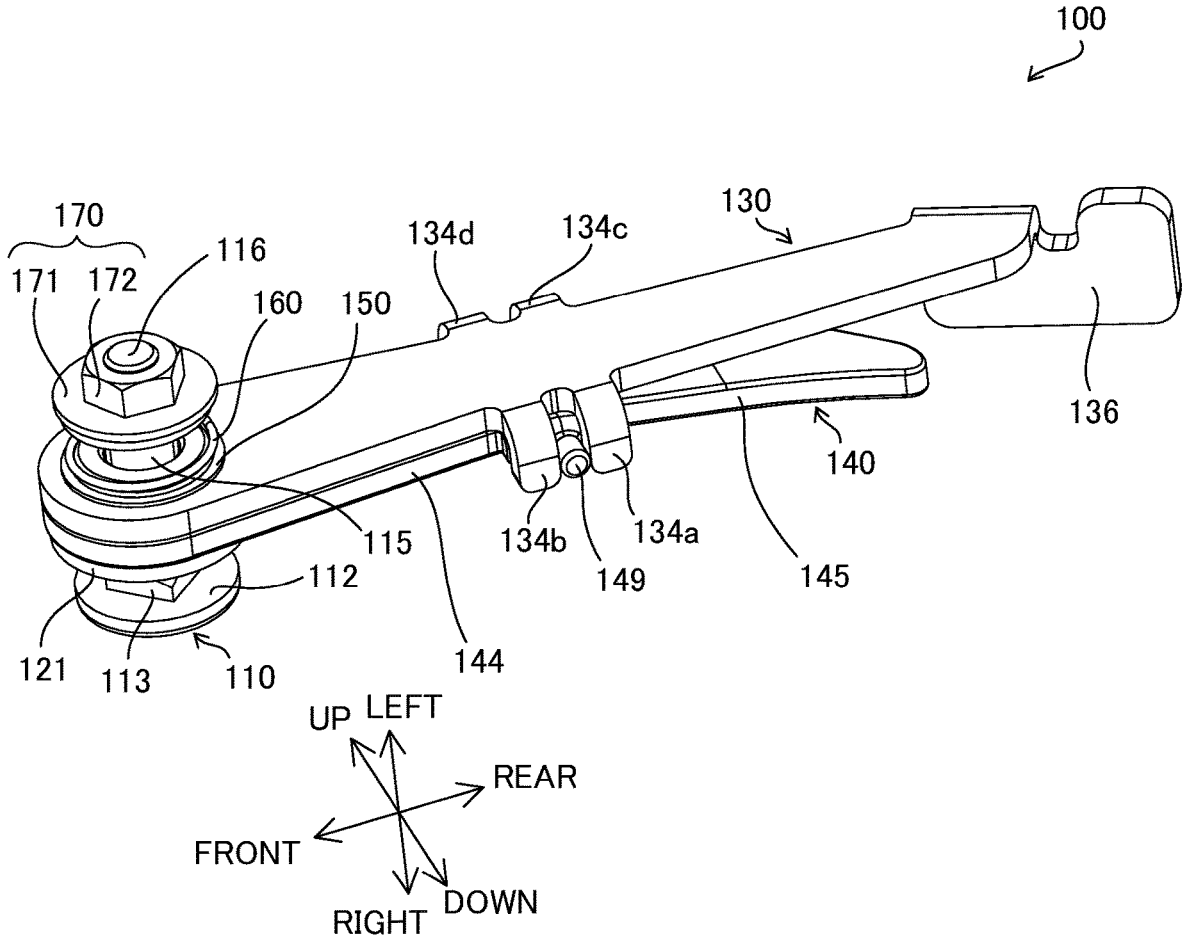
FIG. 3 is a perspective view of the lever device.
Figure 4:
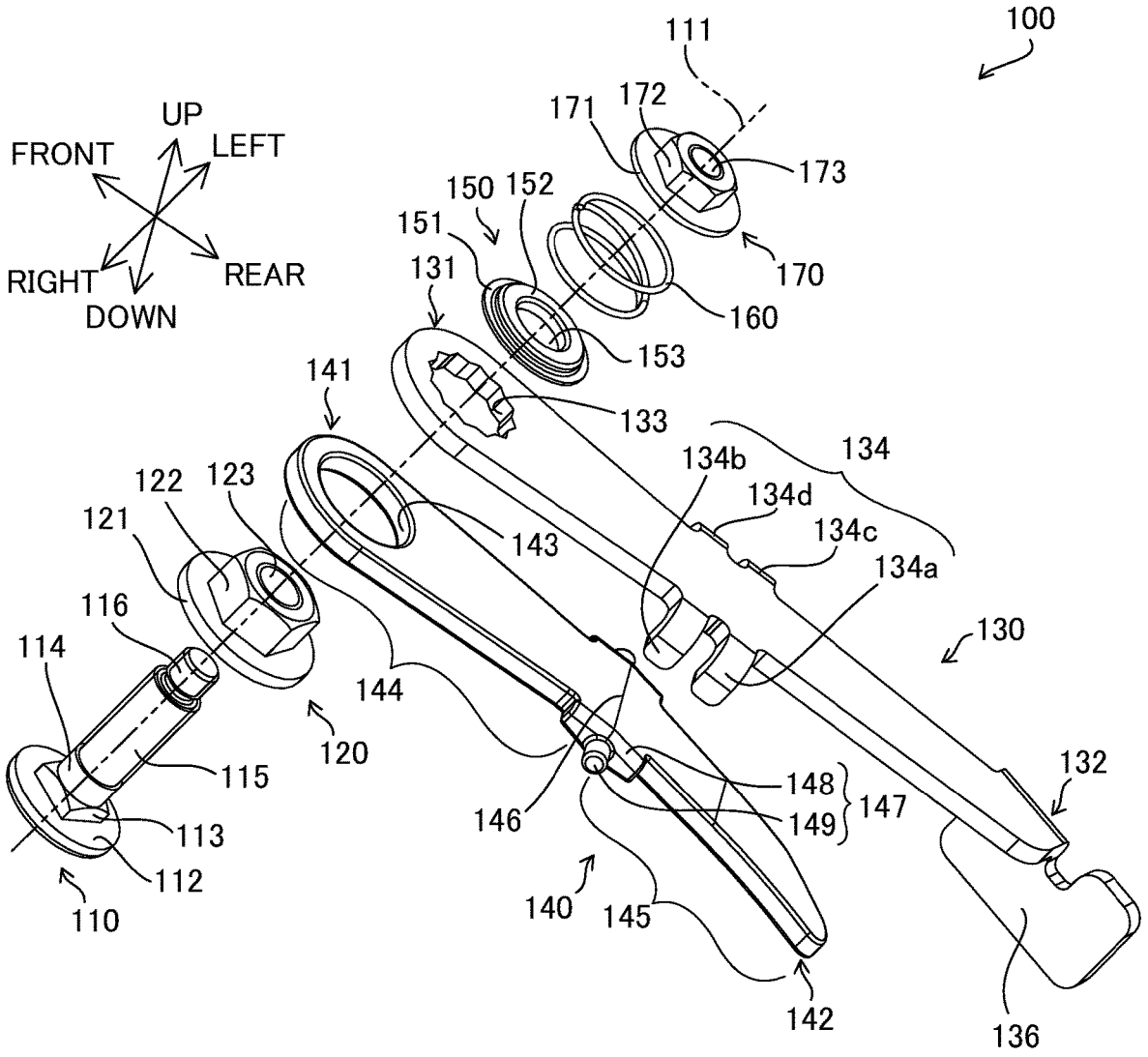
FIG. 4 is an exploded perspective view of the lever device shown in FIG. 3.

As shown in FIG. 3, in a state in which the lever device 100 has been assembled, the fourth engagement parts 147 are engaged with the third engagement part 134. Specifically, one of two column parts 149 is arranged between the claw part 134*a* and the claw part 134*b* with small gaps, and the other one is arranged between the claw part 134*c* and the claw part 134*d* with small gaps. With this configuration, the relative positions of the first plate 130 and the second plate 140 to each other in the rotational direction around the axis 111 are fixed, and the relative positions of the first plate 130 and the second plate 140 to each other in the front-rear direction are fixed.

The width of the base part 148 in the front-rear direction is generally equal to a range where the claw part 134*a* and the claw part 134*b* are disposed in the front-rear direction. The width of the base part 148 in the vertical direction is generally equal to a width (inside dimension) of the claw parts 134*a* and 134*b* in the vertical direction. Thus, as shown in FIG. 3, in a state in which the first plate 130 and the second plate 140 have been assembled, there are only small gaps between the base part 148 and the inner surfaces of the claw parts 134*a* and 134*b*. Similarly, there are only small gaps between the base part 148 and the inner surfaces of the claw parts 134*c* and 134*d*. With this configuration, the looseness of the second plate 140 in the vertical direction is reduced or eliminated.

The washer 150 includes a large diameter part 151, a small diameter part 152 having an outer diameter smaller than an outer diameter of the large diameter part 151, and a through hole 153 that penetrates the large diameter part 151 and the small diameter part 152 in the direction of the axis 111 coaxially with the axis 111. The large diameter part 151 abuts a left surface of the first end part 131 to close an outer edge of the first engagement part 133. The biasing member 160 is in a form of a coil spring. The biasing member 160 is disposed to abut a left surface of the large diameter part 151 and surround the small diameter part 152. With this configuration, the biasing member 160 is held not to be shifted from a position generally coaxial with the axis 111. Further, the biasing member 160 is prevented from partially entering the first engagement part 133.

The end nut 170 includes a flange part 171, a hexagonal part 172, and a through hole 173. The flange part 171 is formed in a disc shape to support the biasing member 160 at the left side thereof. When the end nut 170 is fastened, the biasing member 160 biases the first plate 130 via the washer 150 toward the bolt 110. The hexagonal part 172 adjoins the flange part 171 to be located at the left side of the flange part 171. The hexagonal part 172 has a hexagonal shape in cross-section orthogonal to the axis 111 so as to allow the end nut 170 to be rotated by using a wrench. The through hole 173 penetrates the flange part 171 and the hexagonal part 172 in the direction of the axis 111 coaxially with the axis 111. A female thread to be screwed with the small diameter thread part 116 of the bolt 110 is formed on an inner surface that defines the through hole 173.

The lever device 100 is assembled as described below. Firstly, the large diameter part 115 of the bolt 110 is screwed with the nut 120. Next, the second plate 140 and the first plate 130 are arranged such that the non-circular part 122 of the nut 120 is inserted in the second engagement part 143 and the first engagement part 133. And then, the washer 150 and the biasing member 160 are arranged such that the large diameter thread part 115 and the small diameter thread part 116, which penetrate the through hole 123, the second engagement part 143 and the first engagement part 133, further penetrates the through hole 153 and the biasing member 160. And then, the small diameter thread part 116 and the end nut 170 are screwed to each other. As a result, the lever device 100 shown in FIG. 3 is obtained.

In the lever device 100 assembled as shown in FIG. 3, the first plate 130 and the second plate 140 are located within a width of the operational part 136 in the direction of the axis 111. This configuration is clearly seen in FIG. 5 as the width is indicated by W1. According to this configuration, the lever device 100 can be made compact.

Figure 5:
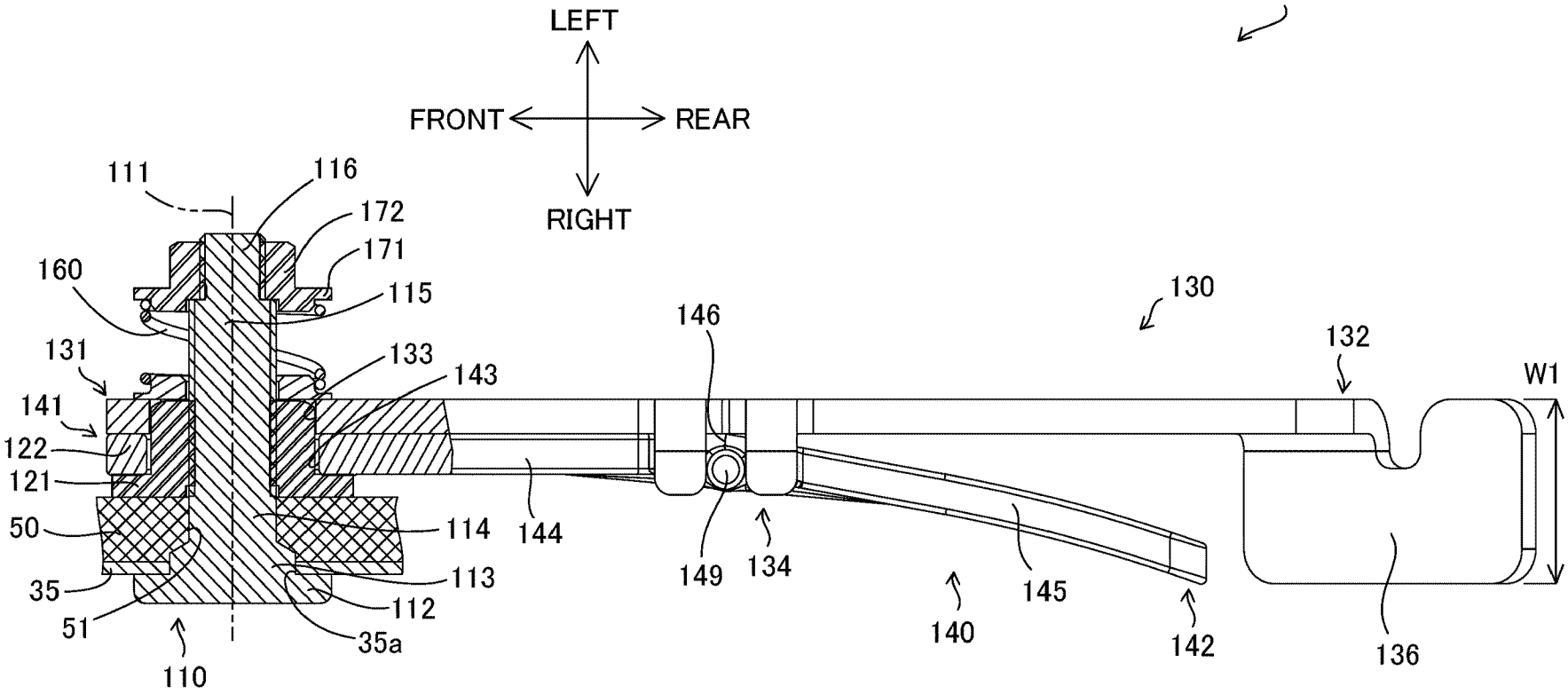
FIG. 5 is a partial cross-sectional view of the lever device in a normal use.

The lever device 100 described above is assembled to the circular saw 10 as shown in FIG. 1 and FIG. 5. Specifically, the bolt 110 is inserted from the right side into the through hole 35*a* of the fixed cover 35 and the guide hole 51 of the depth guide 50. After that, the remaining components of the lever device 100 are assembled at the left side of the depth guide 50 in accordance with the assembling procedure described above. At this time, the polygonal part 113 is inserted in the through hole 35*a* of the fixed cover 35 and the guide hole 51 of the depth guide 50. Since the through hole 35*a* has a polygonal cross-section, when the polygonal part 113 is inserted in the through hole 35*a*, the polygonal part 113 (in other words, the bolt 110) is prevented from being rotated.

The first plate 130 is formed into a flat plate excluding the operational part 136. The second plate 140 is formed in a bent shape as described above. Thus, in a state in which the first plate 130 and the second plate 140 are in surface contact with each other at the front side, in a direction from the non-circular part 122 toward the fourth end part 142, the first plate 130 and the second plate 140 are in contact with each other in a region from the non-circular part 122 to the bent portion of the second plate 140, and the first plate 130 and the second plate 140 are not in contact with each other in the other region at the rear side with respect to the bent portion. The portion of the second plate 140 that is in contact with the first plate 130 is called a contact portion 144, and the portion of the second plate 140 that is not in contact with the first plate 130 is called a non-contact portion 145.

Normally, namely when the fixed cover 35 and the depth guide 50 are fastened or loosened, the lever device 100 is used in a state shown in FIG. 5. In the state shown in FIG. 5, the first engagement part 133 is engaged with the non-circular part 122, so that the relative rotation of the first plate 130 to the non-circular part 122 around the axis 111 is restricted. Thus, when a user pinches the operational part 136 with user's fingers and rotates the first plate 130 downward around the axis 111, the non-circular part 122 is rotated together with the first plate 130. As a result, the nut 120 is fastened to the bolt 110. As a result, the fixed cover 35 and the depth guide 50 arranged between the head part 112 and the flange part 121 are fastened in the direction of the axis 111, so that the relative positions of the fixed cover 35 and the depth guide 50 to each other are fixed. At this time, the relative rotation between the second engagement part 143 and the non-circular part 122 is allowed and the third engagement part 134 is engaged with the column part 149, and therefore the second plate 140 is also rotated together with the first plate 130.

On the other hand, when a user pinches the operational part 136 with user's fingers and rotates the first plate 130 upward around the axis 111, the nut 120 is loosened from the bolt 110. As a result, fixing of the relative positions of the fixed cover 35 and the depth guide 50 to each other is released. Also at this time, the second plate 140 is rotated together with the first plate 130.

Figure 6:
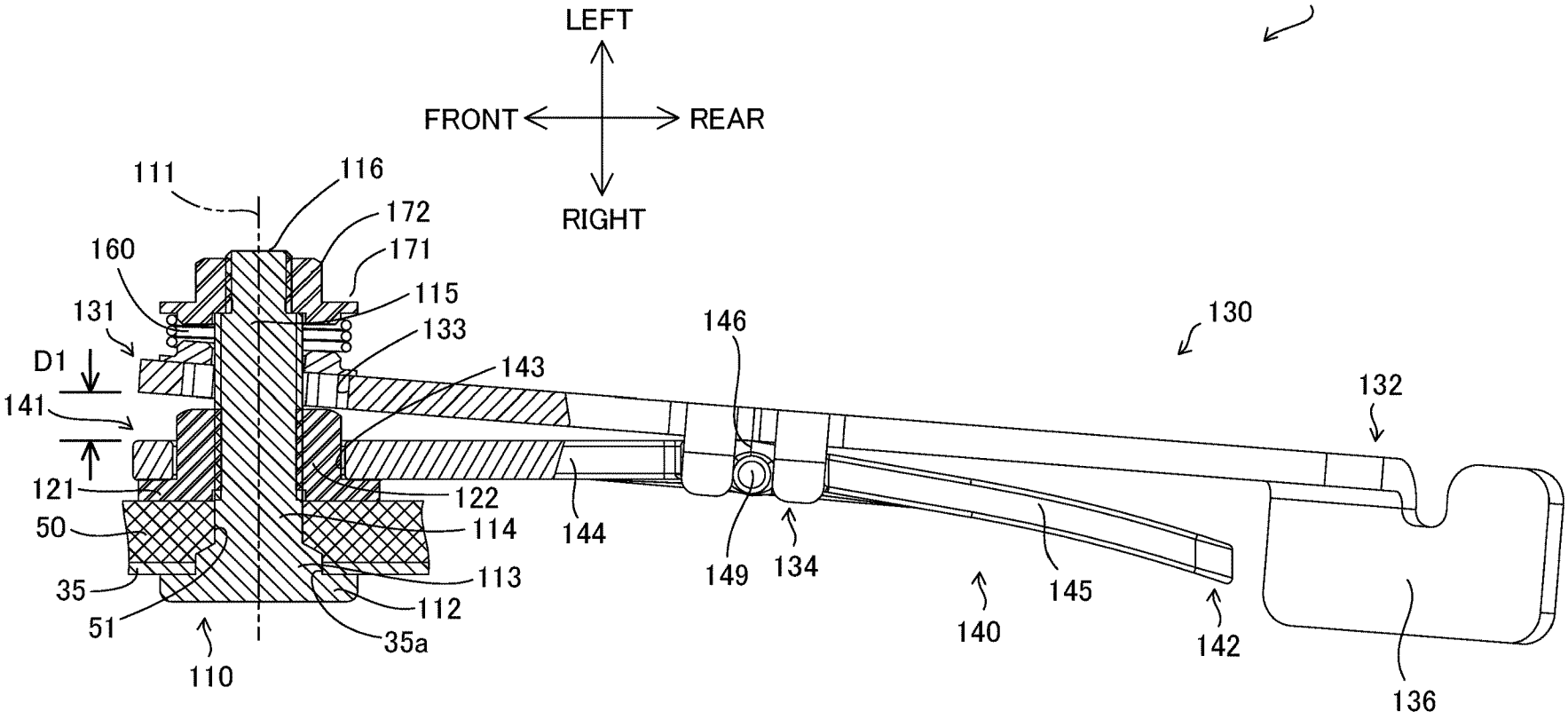
FIG. 6 is a partial cross-sectional view of the lever device when a position of an operational part in a rotational direction is changed.

When the mounting angle of the first plate 130 to the nut 120 is adjusted, a user pinches the second end part 132 and the fourth end part 142 with user's fingers in the lateral direction. As a result, the second end part 132 and the fourth end part 142 are close to each other, and thereby, as shown in FIG. 6, the first plate 130 is rotated according to the principle of leverage with the boundary 146 between the contact part 144 and the non-contact part 145 as a fulcrum. Thus, the first end part 131 is moved against the biasing force of the biasing member 160 so as to be far away from the third end part 141 by a distance D1, and the non-circular part 122 is positioned at an outside of the first engagement part 133. That is, the first plate 130 is moved from an engaged position (FIG. 5) where the first engagement part 133 and the non-circular part 122 are engaged with each other to a non-engaged position (FIG. 6) where the first engagement part 133 and the non-circular part 122 are not engaged with each other. As a result, the restriction of the relative rotation of the first plate 130 to the non-circular part 122 is removed.

In this state, namely in a state in which the second end part 132 and the fourth end part 142 are pinched with user's fingers in the lateral direction, the user rotates the first plate 130 and the second plate 140 upward around the axis 111 by a predetermined angle. Next, the user releases the fingers that have been pinching the second end part 132 and the fourth end part 142. As a result, the first end part 131 is moved to the right side by the biasing force of the biasing member 160.

In the present embodiment, the first engagement part 133 is formed in a dodecagonal shape, and the non-circular part 122 is formed in a hexagonal shape. Thus, when the relative angle between the first engagement part 133 and the non-circular part 122 is changed from the initial state by any multiples of 30 degrees, the non-circular part 122 is positioned in the first engagement part 133 again and the first plate 130 can be returned into the engaged position. Each of the shapes of the first engagement part 133 and the non-circular part 122 may be set in any shape as long as the relative rotation of the first plate 133 to the non-circular part 122 is restricted in a state in which the first engagement part 133 and the non-circular part 122 are engaged with each other, and as long as the first engagement part 133 and the non-circular part 122 are engageable with each other in at least two rotational positions of the first plate 130. The change amount of the relative angle for returning the first plate 130 into the engaged position may be set to any amount depending on the design of each of the shapes of the first engagement part 133 and the non-circular part 122.

According to the lever device 100 described above, the angle of the first plate 130 to the non-circular part 122 (namely, the nut 120) can be changed by a simple operation of a user. In addition, since a user does not need to access the vicinity of the bolt 110, even in a configuration in which the lever device 100 is arranged in a narrow space between the fixed cover 35 and the battery pack to be mounted to the battery pack mounting part 37, the angle of the first plate 130 to the non-circular part 122 can be changed without any difficulties.

Further, according to the lever device 100, the relative rotation between the first plate 130 and the second plate 140 is achieved with the boundary 146 between the contact part 144 and the non-contact part 145 as a fulcrum using a bent shape of the second plate 140. Thus, a configuration of the lever device 100 can be simplified. However, additional component served as a fulcrum may be arranged between the first plate 130 and the second plate 140. Alternatively, a projection, which is projected from one of the first plate 130 and the second plate 140 toward the other one, may be provided as a fulcrum.

Further, according to the lever device 100, the first plate 130 and the second plate 140 can be kept in the same rotational position by the engagement between the third engagement part 134 and the fourth engagement parts 147. Thus, the lever device 100 can be made compact. Further, when a user adjusts the mounting angle of the first plate 130 to the nut 120, it is not necessary to move the second plate 140 to the same rotational position as the first plate 130 for pinching the second end part 132 and the fourth end part 142 with user's fingers. However, the third engagement part 134 and the fourth engagement parts 147 may be omitted.

The third engagement part 134 and the fourth engagement parts 147 are located at generally the same position as the boundary 146 served as a fulcrum, in the direction orthogonal to the axis 111. At a position of the fulcrum, the displacement is the smallest (namely, zero) on the relative rotation between the first plate 130 and the second plate 140, and therefore it is not substantially necessary to take the relative displacement into account when designing the third engagement part 134 and the fourth engagement parts 147. Accordingly, the third engagement part 134 and the fourth engagement parts 147 can be made compact or simplified.

Some embodiments are described above. However the above embodiments are merely described to facilitate understanding of the present invention, and therefore the present invention is not limited to the above embodiments. The present invention can be changed or improved without departing from the spirit of the invention, and further the present invention encompasses the equivalent thereof. Furthermore, embodiments or components described in the claims or this specification may be combined in any manner, and one or more of them may be omitted as long as at least a part of the problem described above can be solved or at least a part of the effects described above can be produced.

For example, an operational part may be disposed on the fourth end part 142 of the second plate 140, instead of the operational part 136. Alternatively, the first plate 130 may be bent in a direction far away from the second plate 140 at a position closer to the second end part 132 than to the first end part 131, instead of the configuration in which the second plate 140 is formed in a bent shape.

The third engagement part 134 and the fourth engagement parts 147 may be formed in any shapes that allow the moving of the first plate 130 between the engaged position and the non-engaged position while fixing the relative positions of the first plate 130 and the second plate 140 to each other in the rotational direction around the axis 111 and the relative positions of the first plate 130 and the second plate 140 to each other in the direction crossing the axis 111. For example, the third engagement part 134 and the fourth engagement parts 147 may have a projection and recess structure in which the third engagement part 134 and the fourth engagement parts 147 are fitted with each other in the lateral direction.

Each of the first engagement part 133 and the second engagement part 143 may not be in a form of a through hole, and may be formed in any shape that does not release the engagement with the non-circular part 122 when the first plate 130 or the second plate 140 is moved in the front-rear direction.

The second engagement part 143 may be engaged with any part on the bolt 110 or the nut 120 instead of the non-circular part 122. For example, the second engagement part 143 may be engaged with the flange part 121. Alternatively, the second plate 140 may be arranged between the axis 111 and the flange part 121 (more specifically, between the depth guide 50 and the flange part 121) in the direction of the axis 111, and the second engagement part 143 may be engaged with the large diameter thread part 115. In this case, a component that partially fills the gap between the first plate 130 and the second plate 140 and that is served as a fulcrum may be disposed between the first plate 130 and the second plate 140.

The lever device 100 may be modified into a configuration in which the bolt is rotated by the first plate 130 from the configuration in which the nut is rotated by the first plate 130. For example, the bolt 110 may have a non-circular part, and the first plate 130 and the second plate 140 may be engaged with the non-circular part.

The lever device 100 is not limited to a device that fixes the depth guide 50 and the fixed cover 35, and the lever device 100 can be applied to various lever devices. For example, the configuration of the lever device 100 may be applied to the lever device 43. Further, the configuration of the lever device 100 can be applied to any lever device that includes a bolt and a nut screwed with the bolt and is configured to fasten the bolt or the nut in various kinds of processing machines other than the circular saw 10.

One aspect of the present disclosure provides a lever device. The lever device includes a bolt, a nut screwed with the bolt, a first plate, and a second plate. The first plate includes a first end part and a second end part. The first plate extends to be elongate from the first end part to the second end part in a crossing direction crossing an axis of the bolt. The second plate includes a third end part and a fourth end part. The second plate extends to be elongate from the third end part to the fourth end part in the crossing direction. The bolt or the nut includes a non-circular part having a non-circular shape in cross-section orthogonal to the axis. The first plate includes a first engagement part to be engaged with the non-circular part, at a position closer to the first end part than to the second end part in the crossing direction. The second plate includes a second engagement part to be engaged with the bolt or the nut, at a position closer to the third end part than to the fourth end part in the crossing direction. The first engagement part is shaped to restrict a relative rotation of the first plate to the non-circular part when the first engagement part is engaged with the non-circular part. The second engagement part is shaped and sized to allow a relative rotation of the second plate to the non-circular part when the second engagement part is engaged with the bolt or the nut. The first engagement part is configured to be engaged with the non-circular part when the first plate is located at a first rotational position with respect to the non-circular part and when the first plate is located at a second rotational position with respect to the non-circular part. The lever device is configured such that, when the first plate and the second plate are moved relatively to each other in a direction in which the second end part and the fourth end part are close to each other from a state in which the second end part and the fourth end part are separated from each other in an axial direction of the bolt, the first plate is rotated around a fulcrum positioned between the first engagement part and the second end part in the crossing direction so that the first plate is moved from an engaged position where the first engagement part and the non-circular part are engaged with each other to a non-engaged position where the first engagement part and the non-circular part are not engaged with each other, and thereby the restriction of the relative rotation of the first plate to the non-circular part is removed.

This lever device can be used for fastening or loosening one of the bolt and the nut to the other one. Specifically, the lever device is normally used in a state in which the first engagement part of the first plate is engaged with the non-circular part of the bolt or the nut. When at least the first plate of the first plate and the second plate is rotated around the axis of the bolt, the non-circular part engaged with the first engagement part is also rotated together with the first plate, so that the bolt or the nut can be fastened or loosened. Further, the lever device is configured to change an angle of the first plate to the non-circular part as described below. Firstly, in a state in which the first plate and the second plate are located at the same rotational position around the axis of the bolt, a user moves the second end part of the first plate and the fourth end part of the second plate to be close to each other. This operation is extremely simple that the second end part and the fourth end part are pinched with a thumb and an index finger to be close to each other. As a result of this operation, the first plate is rotated around the fulcrum positioned between the first engagement part and the second end part in the crossing direction according to the principle of leverage, so that the first plate is moved from the engaged position where the first engagement part is engaged with the non-circular part to the non-engaged position where the first engagement part is not engaged with the non-circular part. The fulcrum may be a part of the first plate or the second plate, or alternatively the fulcrum may be another component disposed between the first plate and the second plate. With the moving of the first plate, the restriction of the relative rotation of the first plate to the non-circular part is removed. Thus, the user then rotates the first plate from the first rotational position to the second rotational position while keeping a state in which the second end part and the fourth end part are close to each other (for example, while keeping a state in which the second end part and the fourth end part are pinched with the thumb and the index finger). And then, the user arranges the second end part and the fourth end part to be far away from each other. As a result, the first plate is returned to the engaged position from the non-engaged position. In this way, the angle of the first plate to the non-circular part is changed. According to this aspect, the angle of the first plate to the non-circular part is changed only by the simple operation that the second end part and the fourth end part are arranged to be close to each other or far away from each other, and thereby the operability for a user is improved. In addition, since a user does not need to access the vicinity of the bolt, the lever device according to this aspect can be arranged in a narrow space (for example, a small space between a blade case and a battery pack).

The second plate may include a contact part and a non-contact part. The contact part contacts the first plate in a predetermined region from the non-circular part toward the fourth end part in an engaged state in which the first engagement part is engaged with the non-circular part and the second engagement part is engaged with the non-circular part. The non-contact part is located at a position closer to the fourth end part than the contact part is located. The non-contact part is not in contact with the first plate in the engaged state due to a bent shape of at least one of the first plate or the second plate. The first plate may be configured to be rotated around a boundary between the contact part and the non-contact part, as a fulcrum. This aspect can eliminate the need for disposing a component to be served as a fulcrum, between the first plate and the second plate. Consequently, the configuration of the lever device can be simplified.

The first engagement part may have a first through hole that penetrates the first plate in the axial direction. The first through hole may be shaped to restrict the relative rotation of the first plate to the non-circular part when an inner surface, which defines the first through hole, of the first plate is engaged with the non-circular part in a state in which the non-circular part is inserted in the first through hole. According to this aspect, the relative rotation of the first plate to the non-circular part can be restricted by a simple configuration.

The second engagement part may have a second through hole that penetrates the second plate in the axial direction. The second through hole may be shaped and sized to allow the relative rotation of the second plate to the non-circular part in a state in which the non-circular part is inserted in the second through hole. According to this aspect, the relative rotation of the second plate to the non-circular part can be allowed by a simple configuration.

The first plate may include a third engagement part. The second plate may include a fourth engagement part. The third engagement part and the fourth engagement part may be configured to be engaged with each other so as to allow moving of the first plate between the engaged position and the non-engaged position while fixing the relative positions of the first plate and the second plate to each other in a rotational direction around the axis and the relative positions of the first plate and the second plate to each other in the crossing direction. According to this aspect, the relative positions of the first plate and the second plate to each other can be fixed at positions where a user can handle the first plate and the second plate easily, so that the operability for the user is improved. For example, according to this aspect, the relative positions of the first plate and the second plate to each other with respect to the rotational direction around the axis are fixed, and thereby a user does not need to arrange the first plate and the second plate at the same rotational position around the axis when the second end part and the fourth end part are arranged to be close to each other for changing the angle of the first plate to the non-circular part.

The third engagement part and the fourth engagement part may be located at generally the same position as the fulcrum in a direction orthogonal to the axis. According to this aspect, a relative moving amount between the third engagement part and the fourth engagement part when the first plate is rotated around the fulcrum is minimized at the position of the fulcrum. Thus, according to this aspect, the third engagement part and the fourth engagement part can be made compact or simplified. In other words, this aspect can eliminate the need for a structure in which the relative moving between the third engagement part and the fourth engagement part is taken into account.

The lever device may further include a biasing member that biases the first plate toward the engaged position. According to this aspect, the first plate is kept at the engaged position unless a user operates the lever device. That is, the first plate is kept in a normal state for fastening one of the bolt and the nut to the other one. In addition, when a user performs an operation for changing the angle of the first plate to the non-circular part, only by releasing the fingers from the second end part and the fourth end part after arranging the second end part and the fourth end part to be close to each other and then rotating the first plate from the first rotational position to the second rotational position, the second end part and the fourth end part are automatically away from each other, and the first plate is returned into the engaged position from the non-engaged position. Consequently, the operation of the user can be extremely easy.

The first plate or the second plate may include an operational part to be operated by a user for rotationally operating the lever device, at the second end part or the fourth end part. The operational part may have a width in the axial direction. The first plate and the second plate may be arranged within the width in a state in which the first engagement part is engaged with the non-circular part and the second engagement part is engaged with the non-circular part. According to this aspect, the lever device can be made compact. For example, the lever device according to this aspect can be formed to be equivalent in size to a well-known lever device including only a single plate (lever) with an operational part.

One aspect of the present disclosure provides a portable cutting machine. The portable cutting machine includes the lever device according to any one of aspects described above. The portable cutting machine further includes a body part including a cutting blade rotatable around a rotational axis, and a fixed cover partially covering the cutting blade. The body part is configured to pivot around a pivotal axis parallel to the rotational axis. The portable cutting machine further includes a depth guide in which a guide hole having an arc shape is formed. The depth guide is arranged between the fixed cover and a portion of the body part other than the fixed cover. The bolt of the lever device penetrates the guide hole. The lever device is disposed for fastening the fixed cover and the depth guide by fastening the bolt or the nut, and thereby fixing a pivotal position of the body part to the depth guide. According to the portable cutting machine, even in a configuration in which the lever device is arranged in a narrow space between the fixed cover and the portion of the body part other than the fixed cover, a user can easily change the angle of the first plate to the non-circular part without accessing the vicinity of the bolt. The portion of the body part other than the fixed cover may be any portion depending on a type of the portable cutting machine. For example, the portion of the body part other than the fixed cover may be a battery pack mounting part, or a battery pack mounted to the battery pack mounting part. Alternatively, the portion of the body part other than the fixed cover may be a handle to be gripped by a user, or a controller housing positioned below the handle.

DESCRIPTION OF NUMERALS

10: portable circular saw, 20: base, 30: body part, 31: motor, 32: handle, 33: trigger, 34: support shaft, 34*a*: pivotal axis, 35: fixed cover, 35*a*: through hole, 36: saw blade, 37: battery pack mounting part, 41: bracket, 42: angular plate, 43: lever device, 44: bolt, 45: nut, 46: lever plate, 50: depth guide, 51: guide hole, 100: lever device, 110: bolt, 111: axis, 112: head part, 113: polygonal part, 114: circular part, 115: large diameter thread part, 116: small diameter thread part, 120: nut, 121: flange part, 122: non-circular part, 123: through hole, 130: first plate, 131: first end part, 132: second end part, 133: first engagement part, 134: third engagement part, 134*a* to 134*d*: claw part, 136: operational part, 140: second plate, 141: third end part, 142: fourth end part, 143: second engagement part, 144: contact part, 145: non-contact part, 146: boundary, 147: fourth engagement part, 148: base part, 149: column part, 150: washer, 151: large diameter part, 152: small diameter part, 153: through hole, 160: biasing member, 170: end nut, 171: flange part, 172: hexagonal part, 173: through hole

The invention claimed is:

1. A lever device for a portable circular saw, said lever device comprising: a bolt attached to a depth guide of the portable circular saw;

a nut screwed with the bolt;

a first plate including a first end part and a second end part, and extending to be elongate from the first end part to the second end part in a crossing direction crossing an axis of the bolt; and a second plate including a third end part and a fourth end part, and extending to be elongate from the third end part to the fourth end part in the crossing direction, wherein the bolt or the nut includes a non-circular part having a non-circular shape in cross-section orthogonal to the axis, the first plate includes a first engagement part to be engaged with the non-circular part, at a position closer to the first end part than to the second end part in the crossing direction, the second plate includes a second engagement part to be engaged with the bolt or the nut, at a position closer to the third end part than to the fourth end part in the crossing direction, the first engagement part is shaped to restrict a relative rotation of the first plate to the non-circular part when the first engagement part is engaged with the non-circular part, the second engagement part is shaped and sized to allow a relative rotation of the second plate to the non-circular part when the second engagement part is engaged with the bolt or the nut, the first engagement part is configured to be engaged with the non-circular part when the first plate is located at a first rotational position with respect to the non-circular part and when the first plate is located at a second rotational position with respect to the non-circular part, and the lever device is configured such that, when the first plate and the second plate are moved relatively to each other in a direction in which the second end part and the fourth end part are close to each other from a state in which the second end part and the fourth end part are separated from each other in an axial direction of the bolt, the first plate is rotated around a fulcrum positioned between the first engagement part and the second end part in the crossing direction so that the first plate is moved from an engaged position where the first engagement part and the non-circular part are engaged with each other to a non-engaged position where the first engagement part and the non-circular part are not engaged with each other, and thereby the restriction of the relative rotation of the first plate to the non-circular part is removed.

2. The lever device according to claim 1, wherein the second plate includes:

a contact part that contacts the first plate in a predetermined region from the non-circular part toward the fourth end part in an engaged state in which the first engagement part is engaged with the non-circular part and the second engagement part is engaged with the non-circular part; and a non-contact part located at a position closer to the fourth end part than the contact part is located, the non-contact part being not in contact with the first plate in the engaged state due to a bent shape of at least one of the first plate or the second plate, and the first plate is configured to be rotated around a boundary between the contact part and the non-contact part, as the fulcrum.

3. The lever device according to claim 1, wherein the first engagement part includes a first through hole that penetrates the first plate in the axial direction, and the first through hole is shaped to restrict the relative rotation of the first plate to the non-circular part when an inner surface of the first plate defining the first through hole is engaged with the non-circular part in a state in which the non-circular part is inserted in the first through hole.

4. The lever device according to claim 1, wherein the second engagement part includes a second through hole that penetrates the second plate in the axial direction, and the second through hole is shaped and sized to allow the relative rotation of the second plate to the non-circular part in a state in which the non-circular part is inserted in the second through hole.

5. The lever device according to claim 1, wherein the first plate includes a third engagement part, the second plate includes a fourth engagement part, and the third engagement part and the fourth engagement part are configured to be engaged with each other so as to allow moving of the first plate between the engaged position and the non-engaged position while fixing the relative positions of the first plate and the second plate to each other in a rotational direction around the axis and the relative positions of the first plate and the second plate to each other in the crossing direction.

6. The lever device according to claim 5, wherein the third engagement part and the fourth engagement part are located at generally the same position as the fulcrum in a direction orthogonal to the axis.

7. The lever device according to claim 1, further comprising a biasing member that biases the first plate toward the engaged position.

8. The lever device according to claim 1, wherein the first plate or the second plate includes an operational part to be operated by a user for rotationally operating the lever device, at the second end part or the fourth end part, the operational part has a width in the axial direction, and the first plate and the second plate are arranged within the width in a state in which the first engagement part is engaged with the non-circular part and the second engagement part is engaged with the non-circular part.

9. A portable cutting machine comprising:

the lever device according to claim 1;

a body part including a cutting blade rotatable around a rotational axis, and a fixed cover partially covering the cutting blade, the body part being configured to pivot around a pivotal axis parallel to the rotational axis; and a depth guide in which a guide hole having an arc shape is formed, the depth guide being arranged between the fixed cover and a portion of the body part other than the fixed cover, wherein the bolt of the lever device penetrates the guide hole, and the lever device is disposed for fastening the fixed cover and the depth guide by fastening the bolt or the nut, and thereby fixing a pivotal position of the body part to the depth guide.

10. The lever device according to claim 1, wherein the second plate includes:

a contact part that contacts the first plate in a predetermined region from the non-circular part toward the fourth end part in an engaged state in which the first engagement part is engaged with the non-circular part and the second engagement part is engaged with the non-circular part; and a non-contact part located at a position closer to the fourth end part than the contact part is located, the non-contact part being not in contact with the first plate in the engaged state due to a bent shape of at least one of the first plate or the second plate, the first plate is configured to be rotated around a boundary between the contact part and the non-contact part, as a fulcrum, the first plate or the second plate includes an operational part to be operated by a user for rotationally operating the lever device, at the second end part or the fourth end part, the operational part has a width in the axial direction, and the first plate and the second plate are arranged within the width in a state in which the first engagement part is engaged with the non-circular part and the second engagement part is engaged with the non-circular part.

11. The lever device according to claim 1, wherein the first engagement part includes a first through hole that penetrates the first plate in the axial direction, the first through hole is shaped to restrict the relative rotation of the first plate to the non-circular part when an inner surface of the first plate defining the first through hole is engaged with the non-circular part in a state in which the non-circular part is inserted in the first through hole, the second engagement part includes a second through hole that penetrates the second plate in the axial direction, and the second through hole is shaped and sized to allow the relative rotation of the second plate to the non-circular part in a state in which the non-circular part is inserted in the second through hole.

* * * * *